US009843082B2

(12) United States Patent
Xue et al.

(10) Patent No.: US 9,843,082 B2
(45) Date of Patent: Dec. 12, 2017

(54) MICROSTRIP LINE FILTER

(71) Applicant: City University of Hong Kong, Kowloon (HK)

(72) Inventors: Quan Xue, Kowloon (HK); Wei Qin, Kowloon (HK)

(73) Assignee: City University of Hong Kong, Kowloon (HK)

( * ) Notice: Subject to any disclaimer, the term of this patent is extended or adjusted under 35 U.S.C. 154(b) by 223 days.

(21) Appl. No.: 14/290,309

(22) Filed: May 29, 2014

(65) Prior Publication Data

US 2015/0022284 A1 Jan. 22, 2015

Related U.S. Application Data

(60) Provisional application No. 61/856,917, filed on Jul. 22, 2013.

(51) Int. Cl.
*H01P 1/203* (2006.01)

(52) U.S. Cl.
CPC ..... *H01P 1/203* (2013.01); *H01P 1/20363* (2013.01); *H01P 1/20381* (2013.01)

(58) Field of Classification Search
CPC .. H01P 1/203; H01P 3/08; H01P 5/028; H01P 7/08; H01P 7/082; H01P 1/20363; H01P 1/20381
USPC ..... 333/202, 204, 238, 246
See application file for complete search history.

(56) References Cited

U.S. PATENT DOCUMENTS 4,455,540 A * 6/1984 Henriot ..... H01P 1/20372 333/202
4,757,286 A * 7/1988 Konishi ..... H01P 1/203 333/204
6,720,849 B2 * 4/2004 Sasaki ..... H01P 1/2039 333/204
7,078,987 B1 * 7/2006 Petrovic ..... H01P 1/203 333/177

OTHER PUBLICATIONS

J.S. Hong and M. J. Lancaster, Microstrip Filters for RF/Microwave Applications. New York: Wiley, chapter 5.2, pp. 121-126, 2001.
J.S. Hong and M. J. Lancaster, "Cross-coupled microstrip hairpin-resonator filters ," IEEE Trans. Microw. Theory Tech., vol. 46, No. 1, pp. 118-122, Jan. 1998.
W. Qin and Q. Xue, "Complementary compact microstrip resonant cell and its applications to single- and dual-band bandpass filters," IEEE Trans. Microw. Theory Tech., vol. 61, No. 2,pp. 773-781 , Feb. 2013.
U. H. Gysel, "New theory and design for hairpin-Line filters ," IEEE Trans. Microw. Theory Tech., vol. 22, No. 5, pp. 523-531, May 1974.

(Continued)

*Primary Examiner* — Benny Lee
*Assistant Examiner* — Jorge Salazar, Jr.
(74) *Attorney, Agent, or Firm* — Renner Kenner Greive Bobak Taylor & Weber

(57) ABSTRACT

A microstrip line filter comprising a coupling mechanism arranged to couple a first resonator and a second resonator, wherein the coupling mechanism includes a shared metallic coupling member arranged to have a predetermined dimension associated with an operation characteristics of the first and second resonators.

22 Claims, 8 Drawing Sheets

(56) References Cited

OTHER PUBLICATIONS

J. W. Zhu and Z. H. Feng, "Microstrip interdigital hairpin resonator with an optimal physical length," IEEE Microw. Wireless Compon. Lett, vol. 16, No. 12, pp. 672-674, Dec. 2006.
A. Worapishet, K. Srisathit, and W. Surakampontorn, "Stepped-impedance coupled resonators for implemention of parallel coupled microstrip filters with spurious band suppression," IEEE Trans. Microw. Theory Tech., vol. 60, No. 6, pp. 1540-1548, Jun. 2012.
K. W. Hsu and W. H. Tu, "Sharp-rejection quad-band bandpass filter using meandering structure," Electron. Lett, vol. 48, No. 15, pp. 935-937, Jul. 2012.
D. M. Pozar, Microwave Engineering, Third Edition. New York: Wiley, chapter 4.6, pp. 203-210, 2005.
L. Li and K. Wu, "Via-hole coupled oversized microstrip line and its bandpass filter application," Int. J. Microw. Millim. Wave Comput. Aided Eng., vol. 18, No. 5, pp. 436-444, Sep. 2008.

* cited by examiner

S11: reflection coefficient
S21: transmission coefficient

S11: reflection coefficient
S21: transmission coefficient

S11: reflection coefficient
S21: transmission coefficient

Fabricated quasi-elliptic response via-coupling band-pass filter

1200

MICROSTRIP LINE FILTER

TECHNICAL FIELD

The present invention relates to a microstrip line filter and particularly, although not exclusively, to a magnetic coupling mechanism arranged to couple resonators in a microstrip line filter.

BACKGROUND OF THE INVENTION

The finite electromagnetic spectrum for modern wireless communications is becoming more and more crowded. Band pass filters with high spectral selectivity are highly demanded to make sufficient use of the electromagnetic spectrum. Microstrip line emerges as a good candidate for band pass filter designs due to its advantages of low cost, planar structure and easy fabrication. Among various microstrip line band pass filters, the traditional end-coupled band pass filters using gap-couplings are simple both in structure and in design procedure. However, the applications of these kinds of filters are not so wide because the performance is too sensitive to the sizes of the feeding and coupling gaps.

On the other hand, according to the coupled resonator theory, resonator and coupling are the two key factors in microwave band-pass filter design. Past research on microwave band pass filters, especially microstrip line band pass filters, had focused on proposing various new kinds of resonators to improve filter performance or achieve special functions. For coupling mechanism, end- and edge-couplings, both of which belong to gap-coupling, dominate the coupling mechanism in microstrip line band pass filters.

Therefore, there is a need for a coupling mechanism that can at least make use of the advantages of the end-coupled structure and yet avoid the disadvantages of the gap-coupling.

SUMMARY OF THE INVENTION

It is an object of the present invention to overcome or substantially ameliorate the above disadvantages or more generally to provide an improved coupling mechanism for microstrip line filter.

In accordance with a first aspect of the present invention, there is provided a microstrip line filter comprising: a coupling mechanism arranged to couple a first resonator and a second resonator, wherein the coupling mechanism includes a shared metallic coupling member arranged to have a predetermined dimension associated with an operation characteristics of the first and second resonators.

Preferably, the operation characteristic comprises a coupling coefficient of the first and second resonators.

In one embodiment of the first aspect, the first and second resonators are end-coupled or edge coupled with each other through the coupling mechanism.

In one embodiment of the first aspect, the microstrip line filter is a band pass filter.

Preferably, the coupling mechanism is substantially gapless between the first and second resonators.

In one embodiment of the first aspect, the shared metallic coupling member has a substantially circular cross section.

In a preferred embodiment of the first aspect, the predetermined dimension of the shared metallic coupling member associated with the coupling coefficient includes a diameter of the circular cross section of the shared metallic coupling member.

In one embodiment of the first aspect, the coupling coefficient of the first and second resonators is further dependent on the widths of the first and second resonators.

Preferably, the coupling mechanism is a magnetic coupling mechanism substantially independent of substrate permittivity $\epsilon$.

In one embodiment of the first aspect, resonant frequencies of the first and second resonators are dependent on the lengths of the first and second resonators.

In one embodiment of the first aspect, the first and second resonators may be uniform-impedance resonance resonators, step-impedance resonators, stub-loaded resonators or other types of resonators.

In one embodiment of the first aspect, the resonators may be $\lambda/2$ or $\lambda/4$ resonators. Alternatively, the resonators may have different lengths (wavelengths).

In accordance with a second aspect of the present invention, there is provided a microstrip line filter comprising a plurality of resonators, each resonator being end-coupled with an adjacent resonator through a via-coupling mechanism having a shared metallic coupling member disposed between the resonators, or a gap-coupling mechanism having a gap disposed between the resonators.

Preferably, the microstrip line filter in accordance with the second aspect of the present invention comprises both the via-coupling mechanism and the gap-coupling mechanism.

In one embodiment of the second aspect, the via-coupling mechanism is a magnetic coupling mechanism and the gap-coupling mechanism is an electric coupling mechanism.

Preferably, the via-coupling mechanism is substantially gapless between the resonators.

In one embodiment of the second aspect, the shared metallic coupling member has a substantially circular cross section.

Preferably, a predetermined dimension of the shared metallic coupling member is associated with an operation characteristic of the resonators connected together through the via-coupling mechanism.

In one embodiment of the second aspect, the operation characteristic comprises a coupling coefficient of the resonators connected together through the via-coupling mechanism.

In one embodiment of the second aspect, the predetermined dimension of the shared metallic coupling member associated with the coupling coefficient is a diameter of the shared metallic coupling member.

In one embodiment of the second aspect, a width of the gap of the gap-coupling mechanism is associated with a coupling coefficient between the resonators connected together through the gap-coupling mechanism.

In a preferred embodiment of the second aspect, the plurality of resonators are arranged in a split ring structure.

In one embodiment of the second aspect, the microstrip line filter includes: a first resonator connected with a microstrip line input; a second resonator coupled with the first resonator; a third resonator coupled with the second resonator; and a fourth resonator coupled with the third resonator and connected with a microstrip line output; wherein the fourth resonator is further coupled with the first resonator such that the resonators are arranged in a split ring structure.

In one embodiment of the second aspect, the resonators are $\lambda/2$ or $\lambda/4$ resonators. Alternatively, the resonators may have different lengths (wavelengths).

In one embodiment of the second aspect, the first and the fourth resonators are $\lambda/4$ resonators; and the second and third resonators are $\lambda/2$ resonators.

In one embodiment of the second aspect, the gap-coupling mechanism is arranged between the first and fourth resonators; and the via-coupling mechanism is arranged between the first and the second resonators, between the second and the third resonators, and between the third and the fourth resonators.

In one embodiment of the second aspect, the split ring structure includes a radius; and a center frequency of the pass band of the band pass filter is dependent on the radius of the split ring structure.

BRIEF DESCRIPTION OF THE DRAWINGS

Embodiments of the present invention will now be described, by way of example, with reference to the accompanying drawings in which:

FIG. 1(*b*) shows a diagram of a via-coupling mechanism arranged between two resonators in accordance with one embodiment of the present invention, FIG. 1(*c*) shows the equivalent lump-element circuit model of FIG. 1(*a*), and FIG. 1(*d*) shows the equivalent lump-element circuit model of FIG. 1(*b*).

DETAILED DESCRIPTION OF THE PREFERRED EMBODIMENT

Figure 1:
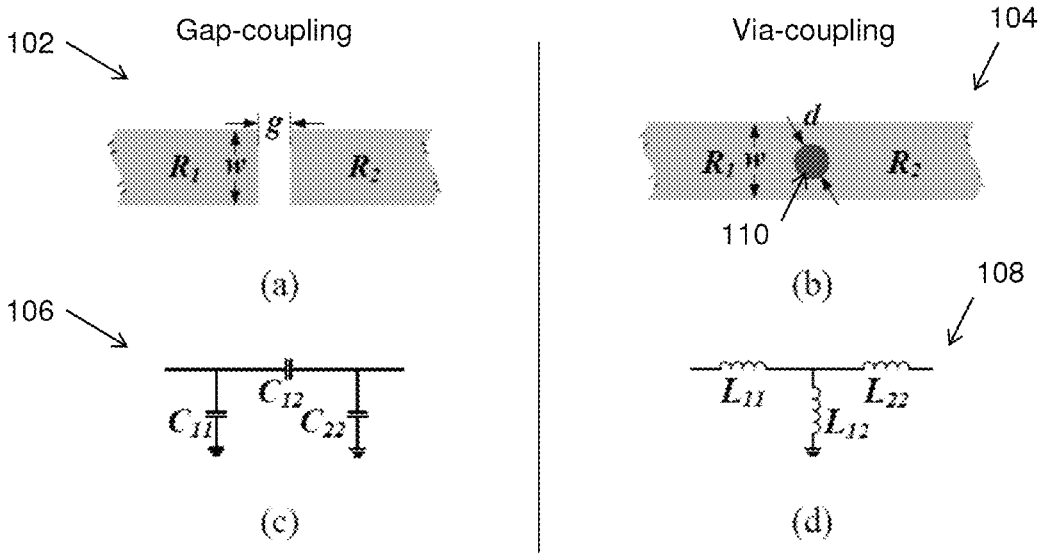
FIG. 1(*a*) shows a diagram of a gap-coupling mechanism.

Referring to FIG. 1(*b*), there is provided a coupling mechanism arranged to couple a first resonator and a second resonator, wherein the coupling mechanism includes a shared metallic coupling member arranged to have a predetermined dimension associated with an operation characteristics of the first and second resonators.

FIG. 1(*a*) shows a diagram 102 of an embodiment of a gap-coupling mechanism used in a microstrip line filter. As shown in FIG. 1(*a*), the gap-coupling mechanism is an end-coupling mechanism realized by a gap with a width g arranged between two resonators $R_1$, $R_2$ (made of substrate, with height h and width w).

Based on the complementary concept of electromagnetics, the inventor of the present invention has devised that a via-coupling mechanism can be realized by sharing one metallic coupling member, a metallic via, between two resonators $R_1$, $R_2$ (made of substrate, with height h and width w) in a microstrip line filter. FIG. 1(*b*) shows a diagram 104 of a via-coupling mechanism in accordance with an embodiment of the present invention in which the circular element represents the metallic via 110. In this embodiment, a metallic via 110 with a substantially circular cross section of diameter d is arranged between the resonators $R_1$, $R_2$. The metallic via 110 may be made of different metallic materials. Unlike in the gap-coupling mechanism, the via-coupling mechanism disposed between the resonators $R_1$, $R_2$ remains substantially 'gapless'.

FIGS. 1(*c*) and 1(*d*) show the lump-element circuit models 106, 108 for the gap-coupling mechanism of FIG. 1(*a*) and the via-coupling mechanism of FIG. 1(*b*) respectively, without taking into account radiation and material losses.

As shown in FIG. 1(*c*), the parallel capacitors, $C_{11}$ and $C_{22}$, represent the gap capacitances to the ground whilst a series capacitor $C_{12}$ represents the gap capacitance between the two resonators. On the other hand, in FIG. 1(*d*), the series inductors, $L_{11}$ and $L_{22}$, represent the current changes caused by the metallic via 110 whilst a parallel inductor $L_{12}$ represents the inductance of the metallic via 110.

The circuit models 106, 108 show the complementariness between the gap-coupling and via-coupling mechanisms, with parallel capacitors $C_{11}$, $C_{22}$ corresponding to series inductors $L_{11}$, $L_{22}$ and series capacitor $C_{12}$ corresponding to parallel inductor $L_{12}$. In addition, the circuit models 106, 108 show that the gap-coupling mechanism is an electric coupling mechanism whereas the via-coupling mechanism is a magnetic coupling mechanism.

In coupled resonator theory, the coupling between resonators is characterized mainly by one parameter/operation characteristic, a coupling coefficient, which is much simpler than a three-parameter circuit model. Therefore, the inventor of the present invention has devised that the via-coupling mechanism can be characterized and studied using the coupled resonator theory. As resonator and coupling are the two essential factors of a microwave band pass filter, the study of coupling mechanisms in one embodiment of the present invention is based on a certain kind of resonator.

Figure 2:
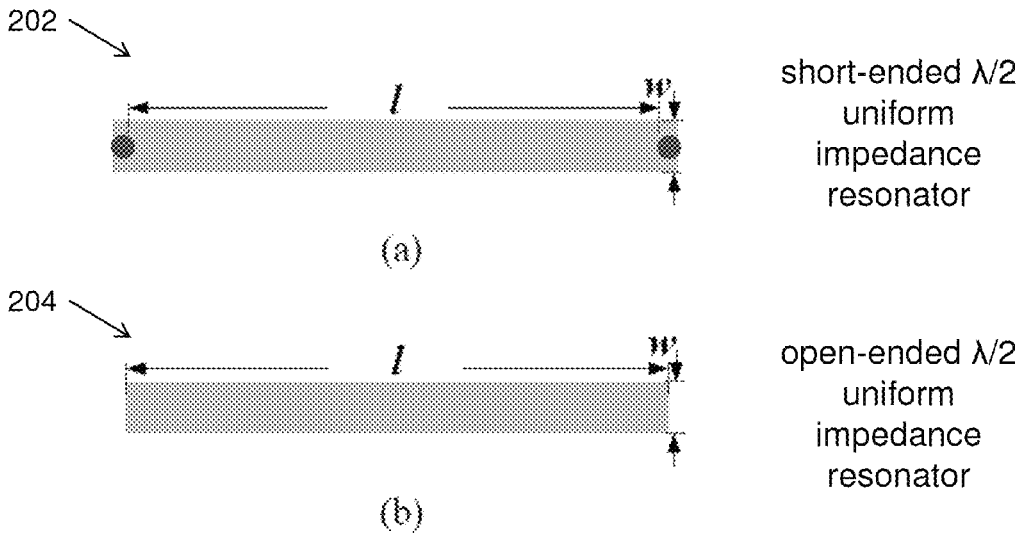
FIG. 2(*a*) shows the schematics of short-ended λ/2 uniform impedance resonator, and FIG. 2(*b*) shows the open-ended λ/2 uniform impedance resonator used for studying the coupling mechanisms in accordance with one embodiment of the present invention.

In this embodiment, without loss of generality, the inventor has chosen to utilize a short-ended λ/2 uniform-impedance resonator (UIR) 202 as shown in FIG. 2(*a*) to investigate the operation characteristic of the via-coupling mechanism of FIG. 1(*b*), and an open-ended λ/2 UIR 204 as shown in FIG. 2(*b*) to investigate the operation characteristic of the corresponding gap-coupling mechanism of FIG. 1(*a*). It should be understood that the application of the via-coupling and gap-coupling mechanisms are not limited to a specific type of resonator. Rather, the via-coupling and gap-coupling mechanisms of the present invention are applicable for different types of resonators, such as but not limited to uniform-impedance resonance resonators, step-impedance resonators and stub-loaded resonators.

According to coupled resonator theory, the coupling coefficient between two coupled resonators can be extracted by the following equation:

$$M = \pm\left|\frac{f_{p2}^2 - f_{p1}^2}{f_{p2}^2 + f_{p1}^2}\right| \tag{1}$$

where $f_{p1}$ and $f_{p2}$ denotes the two split resonant frequencies of the coupled structure; the upper sign is for magnetic coupling and the lower sign is for electric coupling. By using Equation (1), the coupling coefficients of the via-coupling mechanism versus normalized widths w/h and normalized diameters d/h are plotted in FIG. 3. In the graph 300 of FIG. 3, h denotes the height, i.e. "thickness", of the substrate of the resonators.

Figure 3:
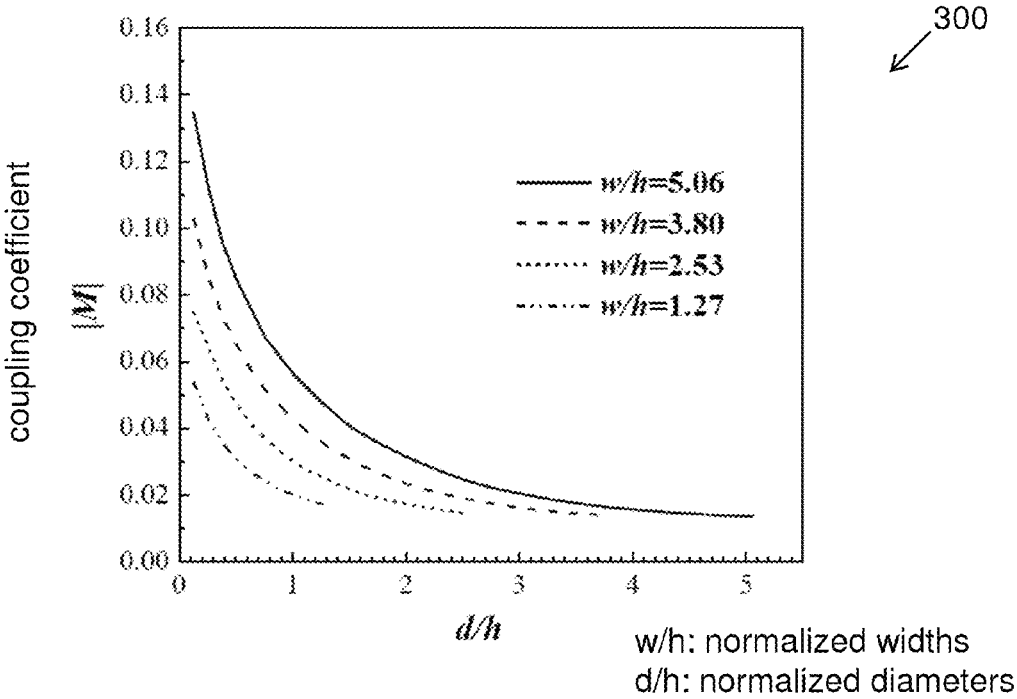
FIG. 3 is a graph of the coupling coefficient (M) against normalized diameters (d/h) at different normalized widths (w/h) for the via-coupling mechanism of FIG. 1(*b*)

As shown in FIG. 3, the upper bounds of the horizontal axis are distinct because there is a restriction that d/h≤w/h. In the present embodiment, the values of w/h are chosen as 1.27, 2.56, 3.80, and 5.06 as the circuit designs in the following sections are based on the substrate Duroid 5870, with a relative permittivity ϵ of 2.33, a loss tangent of 0.0012, and a height/thickness of 0.79 mm. It should be noted that, however, substrates of various forms and materials can also be used in the circuit. Nonetheless, in FIG. 3, the corresponding widths w are set as 1 mm, 2 mm, 3 mm, and 4 mm for design continence.

Figure 4:
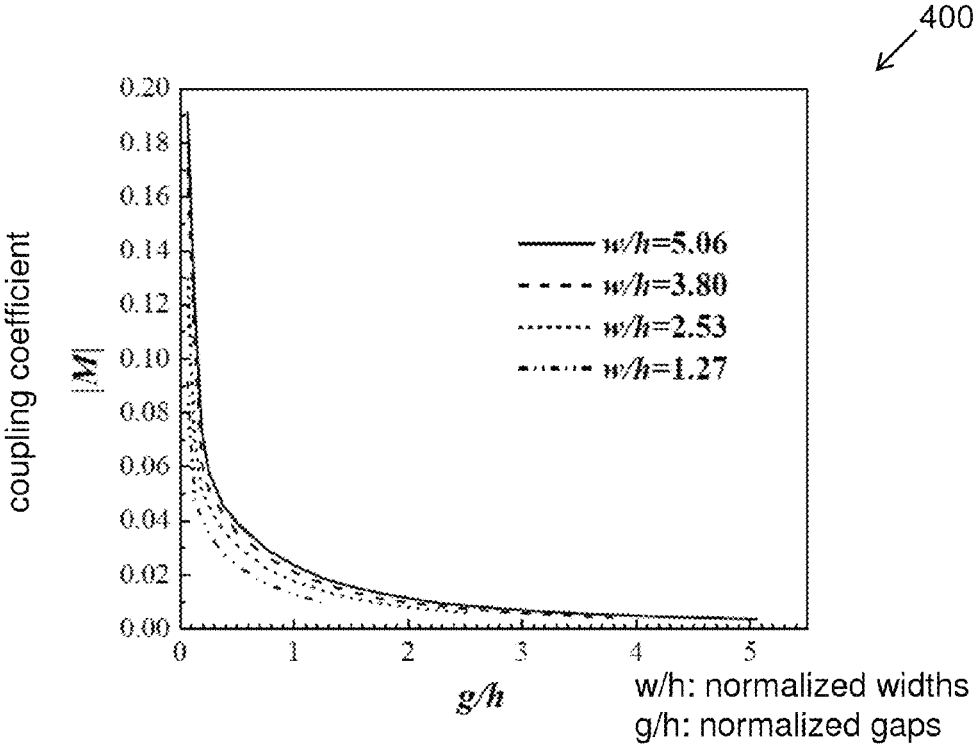
FIG. 4 is a graph of the coupling coefficient (M) against normalized gaps (g/h) at different normalized widths (w/h) for the gap-coupling mechanism of FIG. 1(*a*)

As discussed above, the inventor of the present invention has devised through experiments and trials that the gap-coupling and via-coupling mechanisms are complementary and therefore there is a need to compare the performances of these coupling mechanisms. FIG. 4 shows a graph 400 of the absolute values of the gap-couplings versus normalized widths w/h and normalized gaps g/h. In this embodiment, again, the values of w/h are chosen as 1.27, 2.56, 3.80, and 5.06. Also, in this embodiment, g/h is restricted to be no bigger than w/h. However, it should be noted this restriction is not absolutely essential in some other embodiments.

By comparing FIG. 3 with FIG. 4, the inventor has devised the following conclusions:

Firstly, for fixed w/h, the coupling coefficient of the via-coupling mechanism in the present embodiment decreases moderately and smoothly as d/h increases. However, the coupling coefficient of the gap-coupling mechanism decreases rapidly in the strong coupling region (especially when g/h is below 0.3), yet slowly in weak coupling region. This means that in strong coupling region, the fabrication tolerance of the via-coupling mechanism is much better than that of the gap-coupling mechanism. However, the situation is reversed in the weak coupling region, with the gap-coupling mechanism having a much better fabrication tolerance than that of the via-coupling mechanism.

Secondly, for fixed d/h, the coupling coefficient of the via-coupling mechanism of the present embodiment increases almost linearly and significantly when w/h increases. However, the coupling coefficient of the gap-coupling mechanism changes very little when w/h changes. This shows that the coupling coefficient of the via-coupling mechanism can be controlled by the width w of the microstrip line resonators and this provides via-coupling mechanism with an additional design variable that may be manipulated.

Figure 5:
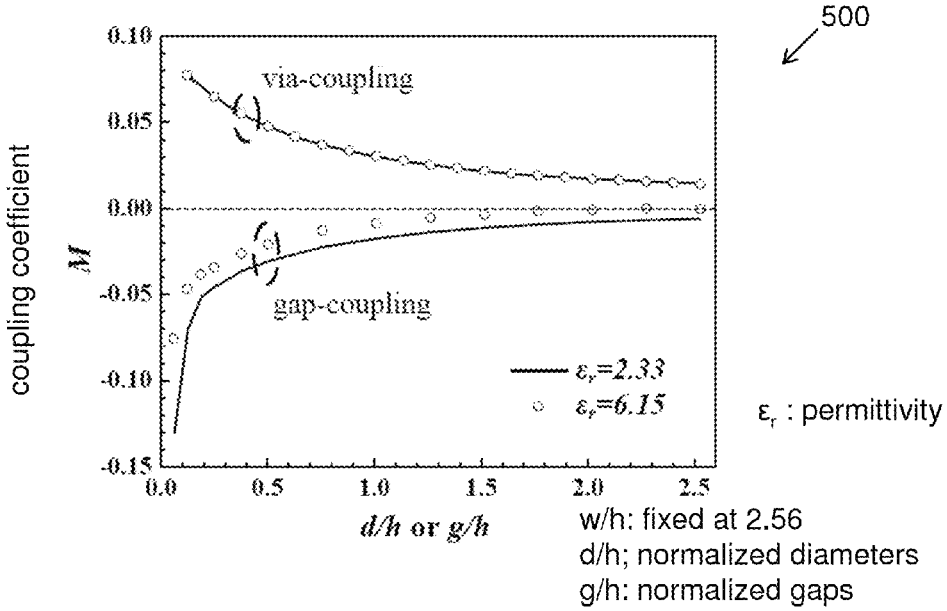
FIG. 5 is a graph of the calculated coupling coefficient (M) against normalized diameters or gaps (d/h or g/h) at different permittivity $\epsilon_r$ for the via-coupling mechanism and gap-coupling mechanism of FIGS. 1(*b*) and 1(*a*), respectively, wherein w/h is fixed at 2.56, and the via-coupling mechanism is positive and the gap-coupling mechanism is negative.

FIG. 5 shows a graph 500 of the calculated coupling coefficients of the two couplings for different substrate relative permittivity $\epsilon_r$ when w/h is fixed to 2.53. As shown in FIG. 5, the absolute value of the coupling coefficient of the gap-coupling mechanism becomes smaller for higher $\epsilon_r$ whilst the coupling coefficient of the via-coupling mechanism is substantially independent of $\epsilon_r$. The inventor of the present invention has devised that this phenomenon can be explained by the definition of the coupling coefficient:

$$M = \frac{\iiint \varepsilon \bar{E}_1 \cdot \bar{E}_2 dv}{\sqrt{\iiint \varepsilon |\bar{E}_1|^2 dv \times \iiint \varepsilon |\bar{E}_2|^2 dv}} + \frac{\iiint \mu \bar{H}_1 \cdot \bar{H}_2 dv}{\sqrt{\iiint \mu |\bar{H}_1|^2 dv \times \iiint \mu |\bar{H}_2|^2 dv}} \tag{2}$$

where E and H represent the electric and magnetic field vectors on the resonators (the subscripts indicate the notations of the resonators); ϵ and μ are the absolute permittivity and permeability respectively.

In Equation (2), the first part of the equation is for electric coupling and the second part of the equation is for magnetic coupling. Due to the existence of air in the microstrip line structure, ϵ is inhomogeneous so that it cannot be extracted from the integrals in the electric-coupling part of (2). Since gap-coupling mechanism belongs to an electric coupling, it should be dependent on ϵ (or $\epsilon_r$). Via-coupling mechanism, on the other hand, belongs to magnetic coupling which is substantially independent of ϵ (or $\epsilon_r$).

The inventor of the present invention has devised that traditional end-coupled band pass filters using gap-coupling mechanisms are simple in structure and in design procedure. However, the inventor has devised that the applications of these kinds of filters are not so wide for at least the following reasons.

First, the performance of theses filters (using gap-coupling) is too sensitive to the sizes of the coupling gap widths g realized by PCB fabrication. Fortunately, the via-coupling mechanism proposed in the present invention is substantially free of this kind of problem.

Secondly, traditional end-coupled band pass filters are often fed by the gaps between input/output of the microstrip line filters and the first/last resonators. The inventor has devised that, in this case, the filter performance is more sensitive to the feeding gaps because the feeding gaps are usually even narrower than the coupling gaps. Accordingly, in one embodiment of the present invention, both end-coupled band pass filters are fed by narrow microstrip lines, which are directly connected to the resonators. This feeding method allows the input/output external quality factor ($Q_E$) to be easily controlled.

Figure 6:
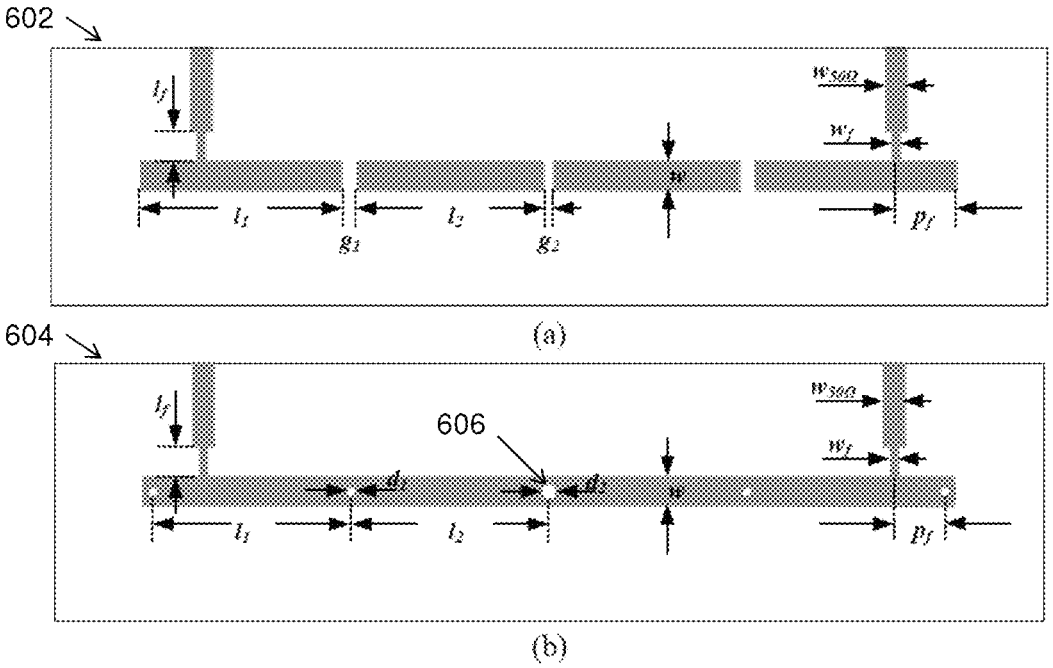
FIG. 6(*a*) shows a diagram of a fourth order end-coupled gap-coupling uniform impedance resonator band pass filter, and FIG. 6(*b*) shows a diagram of a fourth order end-coupled via-coupling uniform impedance resonator band pass filter in accordance with one embodiment of the present invention.

FIGS. 6(*a*) and 6(*b*) show two fourth-order end-coupled band pass filters using gap-coupling mechanisms and via-coupling mechanisms respectively in accordance with an embodiment of the present invention. In both band pass filters, for a given width w, lengths $l_1$ and $l_2$ define the resonant frequencies of the resonators; $g_1/d_1$ and $g_2/d_2$ control the quantities of the couplings and the input/output external quality factor $Q_E$ is mainly controlled by feeding point $p_f$.

The following steps are the design procedures for a band pass filter with specifications including a center frequency $f_c$ and a fractional bandwidth FBW in accordance with one embodiment of the present invention.

1. Generating the coupling matrix together with $Q_E$ based on the given filter specifications. In one embodiment, the coupling matrix for a fourth-order Chebyshev response band pass filter is as follows:

$$[M] = \begin{bmatrix} 0 & M_{12} & 0 & 0 \\ M_{12} & 0 & M_{23} & 0 \\ 0 & M_{23} & 0 & M_{34} \\ 0 & 0 & M_{34} & 0 \end{bmatrix} \tag{3}$$

It should be noted that, this method is not limited to the above coupling matrix. In some other embodiments, different mathematical models and formulas related to the coupling coefficients may be used.

2. Obtaining the parameters that control the couplings, $d_1/g_1$ and $d_2/g_2$, by comparing FIG. 3 and/or FIG. 4 with the coupling coefficients in the matrix [M] of Equation (3).

3. Tuning the length of the resonators, $l_1$ and $l_2$, to guarantee that their resonant frequencies are around $f_c$.

4. Tuning the feeding point, $p_f$, to reach the required $Q_E$.

5. Processing a fine tuning to get optimized frequency responses.

Figure 7:
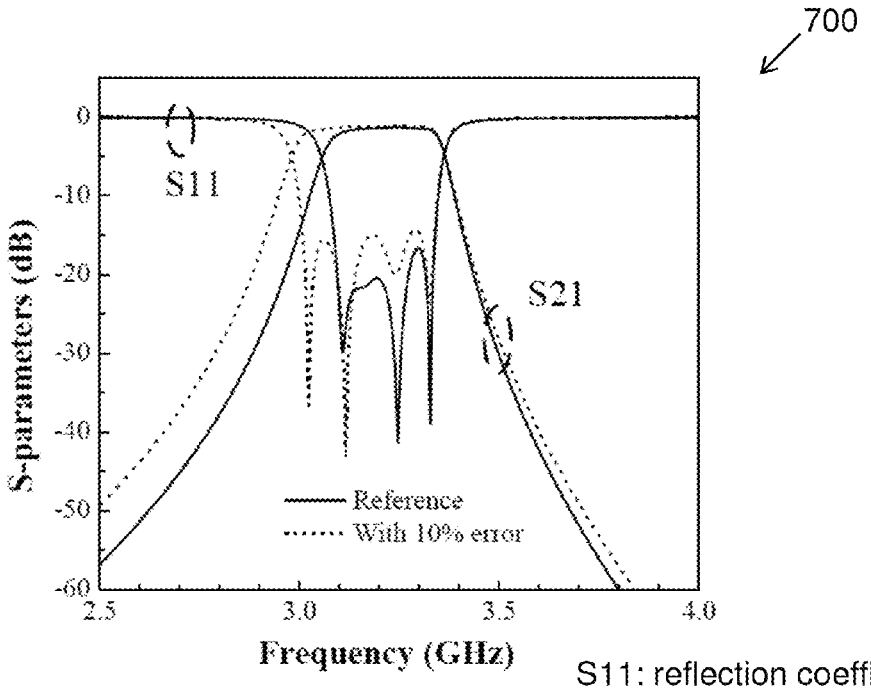
FIG. 7 shows a graph of the simulated frequency response for the end-coupled gap-coupling uniform impedance resonator band pass filter of FIG. 6 and the results for a 10% error in the center gap ($g_2$)
Figure 8:
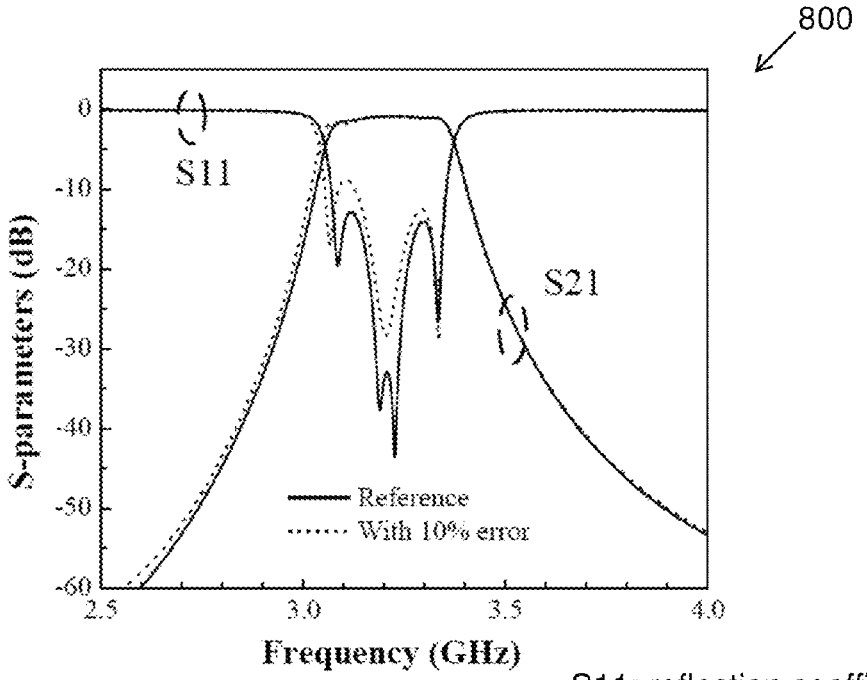
FIG. 8 shows a graph of the simulated frequency response for the end-coupled via-coupling uniform impedance resonator band pass filter of FIG. 6(*b*) and the results for a 10% error in the diameter ($d_2$) of the center metallic via.

FIG. 7 and FIG. 8 show the simulated frequency response 700 for the end-coupled gap-coupling uniform impedance resonator band pass filter of FIG. 6 and the results for a 10% error in the center gap ($g_2$); as well as the simulated frequency response 800 for the end-coupled via-coupling uniform impedance resonator band pass filter of FIG. 6 and the results for a 10% error in the diameter ($d_2$) of the center metallic via 606.

As shown in FIG. 7 and FIG. 8, the solid curves show the simulated frequency responses of two designed example band pass filters of FIG. 6 in an embodiment of the present invention. The parameters $g_2$ and $d_2$ of FIG. 6 are chosen to perform a sensitivity analysis and they show errors of 10%. The dashed curves in FIG. 7 and FIG. 8 show the simulated frequency responses for the two band pass filters with errors in $g_2$ and $d_2$, respectively. For gap-coupling band pass filter, the 10% error in $g_2$ causes a 40% change in bandwidth whilst for via-coupling band pass filter, the 10% error in $d_2$ causes only a 5.8% bandwidth change. Similar results are expected to be obtained if the effect of $g_1$ and $d_1$ are studied. Consequently, the via-coupling mechanism of the present invention presents a better choice for microwave band pass filter design over gap-coupling as it may provide better fabrication tolerance.

The inventor of the present invention has devised that, in most wireless communication systems, band pass filters with high selectivity are more desirable. To realize high-selectivity band pass filters, transmission zeros (TZs) may be generated close to the pass-bands by introducing cross-couplings between non-adjacent resonators. For a fourth-order BPF with cross-coupling between the first and fourth resonators, two TZs can be easily generated to obtain a quasi-elliptic frequency response.

In this case, the coupling matrix is:

$$[M] = \begin{bmatrix} 0 & M_{12} & 0 & M_{14} \\ M_{12} & 0 & M_{23} & 0 \\ 0 & M_{23} & 0 & M_{34} \\ M_{14} & 0 & M_{34} & 0 \end{bmatrix} \tag{4}$$

where $M_{14}$ is the cross-coupling and $M_{12}$, $M_{23}$, $M_{34}$ are the main couplings. The condition is that the cross-coupling should have an opposite sign to the main couplings so that signals from the two paths will eliminate each other and this signal elimination generates TZs. Based on this concept, a fourth order end-coupled BPF with quasi-elliptic response in accordance with an embodiment of the present invention is provided by combining the gap-coupling and via-coupling mechanisms in accordance with one embodiment of the present invention.

Figure 9:
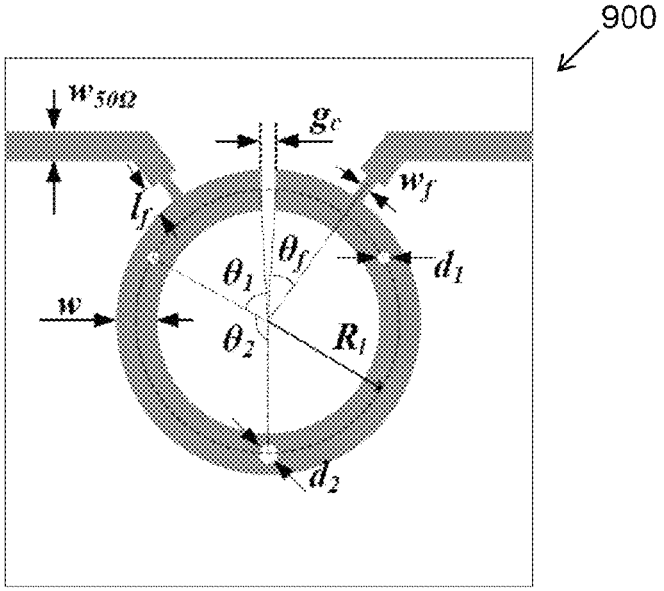
FIG. 9 shows a diagram of an end-coupled uniform impedance resonator quasi-elliptic response band pass filter in accordance with one embodiment of the present invention.

Referring to FIG. 9, there is shown a microstrip line filter comprising a plurality of resonators, each resonator being end-coupled with an adjacent resonator through a via-coupling mechanism having a shared metallic coupling member disposed between the resonators, or a gap-coupling mechanism having a gap disposed between the resonators.

FIG. 9 shows a fourth order end-coupled band pass filter 900 in one embodiment of the present invention. As shown in FIG. 9, the first and fourth resonators are λ/4 uniform-impedance resonators (UIRs) whilst the second and third resonators are λ/2 UIRs. In the present embodiment, all the resonators are bended to form a split ring structure so that the open ends of the λ/4 UIRs can be coupled together through a gap-coupling mechanism. The gap coupling mechanism contributes to the cross-coupling, which has an opposite sign to the main via-coupling mechanism. The physical lengths of the λ/4 and λ/2 UIRs are approximately equal to $R_1\theta_1$ and $R_1\theta_2$ respectively. In this embodiment, the main via-coupling mechanisms are dependent on the diameters $d_1$ and $d_2$ of the metallic via, whilst the cross-coupling is controlled by the gap width $g_c$. Also, the feeding point is dependent on arc length $R_1\theta_f$. The design procedure of the band pass filter in this embodiment is similar to that of the Chebyshev response band pass filter. Although FIG. 9 teaches a fourth order end-coupled band pass filter using two types of different resonators, it should be appreciated that other forms of resonators may be used in some other embodiments without deviating from the spirit of the present invention. Also, the resonators in some other embodiments are not necessarily in a bended structure. Rather, the resonators can take up any shape or form in different embodiments of the present invention.

Figure 10:
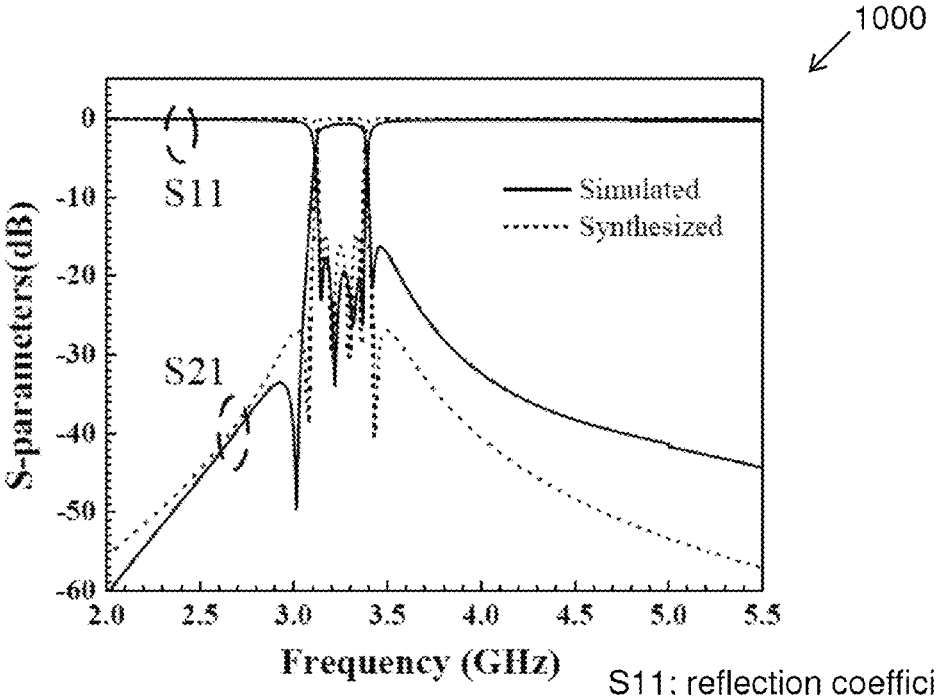
FIG. 10 shows a graph of the simulated frequency responses and the theoretically synthesized results of the end-coupled uniform impedance resonator quasi-elliptic response band pass filter of FIG. 9.

FIG. 10 shows the simulated responses together with the theoretically synthesized results 1000 of the quasi-elliptic band pass filter of FIG. 9. As shown in FIG. 10, good agreements between the simulated response and the synthesized results have been obtained except the slight shifts in the TZs. These slight shifts may be due to the fact that there is a small quantity of power leaking from the first/second resonators to the third/fourth resonators, resulting a non-zero $M_{13}$ and $M_{24}$ in the coupling matrix. More importantly, the cross-coupling gap ($g_c$) in this embodiment is in the weak coupling region of FIG. 4. Therefore, all the coupling parameters ($g_c$, $d_1$ and $d_2$) are insensitive to fabrication errors. This means the proposed structure in the present embodiment owns excellent fabrication tolerance even though gap-coupling mechanisms are used.

The present embodiment of the microstrip line filter has high flexibility of tuning not only for its center frequency, but also for its bandwidth. By just changing the radius of the ring $R_1$ in FIG. 9, the center frequency of the pass-band can be tuned without affecting the FBW, as shown in the graph 1102 of FIG. 11(*a*).

Figure 11:
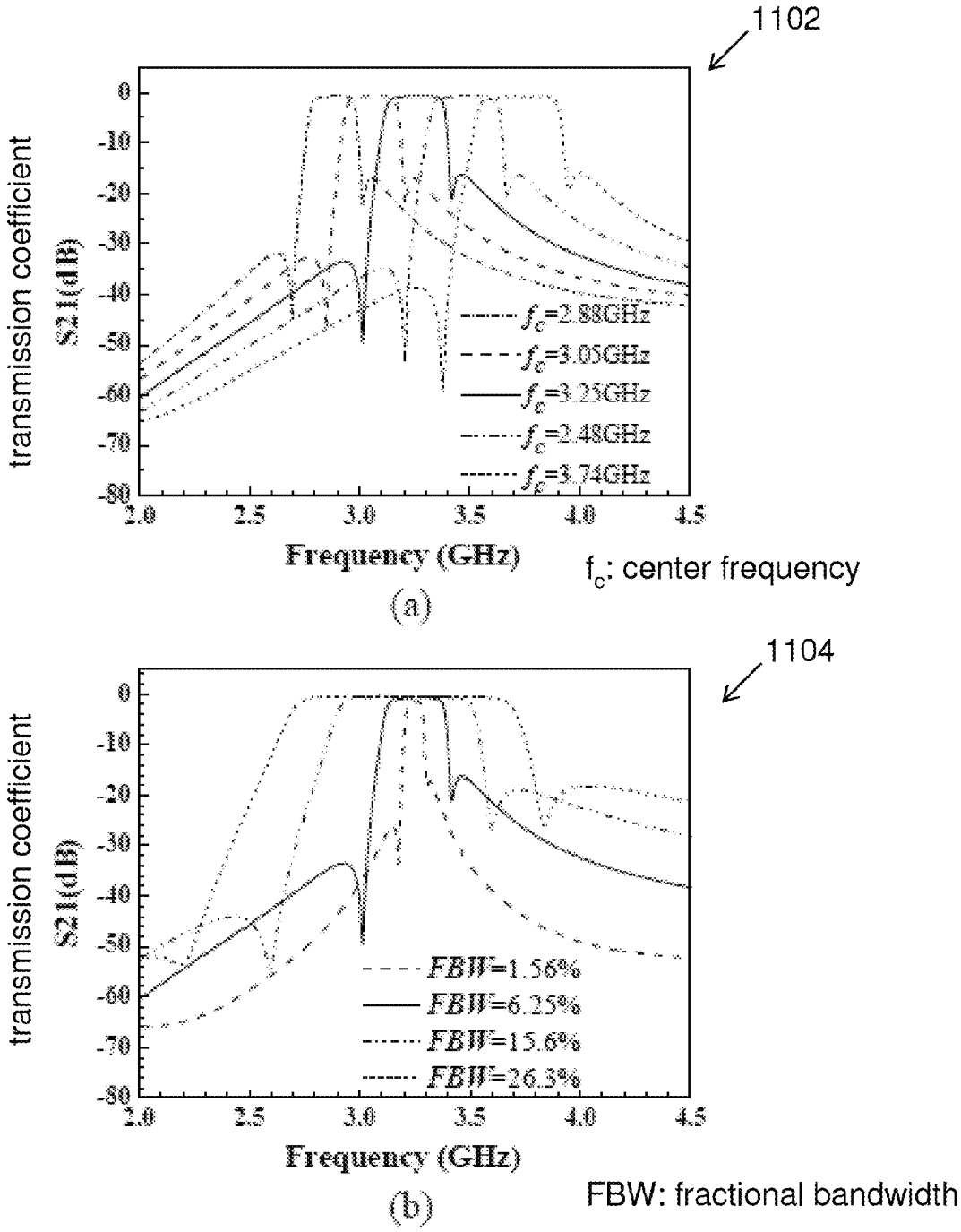
FIG. 11(*a*) shows the graph of simulated transmission responses (S21) of the quasi-elliptic response band pass filter of FIG. 9 with the same fractional bandwidth but different center frequency, and FIG. 11(*b*) shows the graph of simulated transmission responses (S21) of the quasi-elliptic response band pass filter of FIG. 9 with the same center frequency but different fractional bandwidth.

FIG. 11(*b*) shows a graph 1104 of the transmission responses (S21) of band pass filters with same center frequencies and different FBWs. The FBW as shown varies in a wide dynamic range, from 1.56% to 26.3%. To obtain FIG. 11(*b*), w is changed whilst $d_1$ and $d_2$ are kept unchanged so that the FBW varies. However, the center frequency will be also affected by w. In FIG. 11(*a*), the center frequency could be controlled to be maintained the same value by tuning $R_1$. Nonetheless, the present embodiment of the structure 900 shows much flexibility in quasi-elliptic response band pass filter design.

Figure 12:
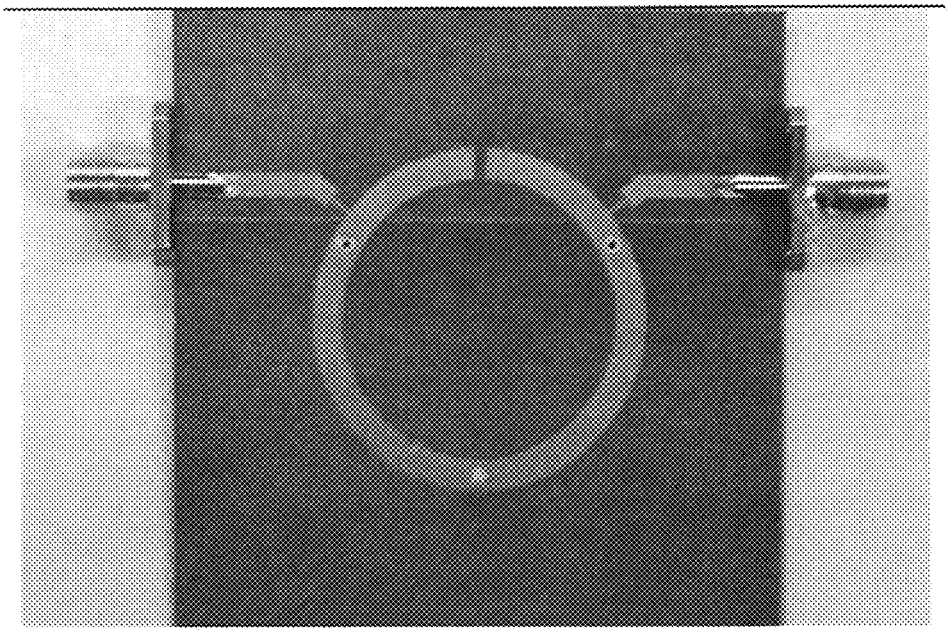
FIG. 12 shows a picture of a fabricated quasi-elliptic response via-coupling band pass filter fabricated based on the band pass filter design of FIG. 9 in accordance with one embodiment of the present invention.
Figure 13:
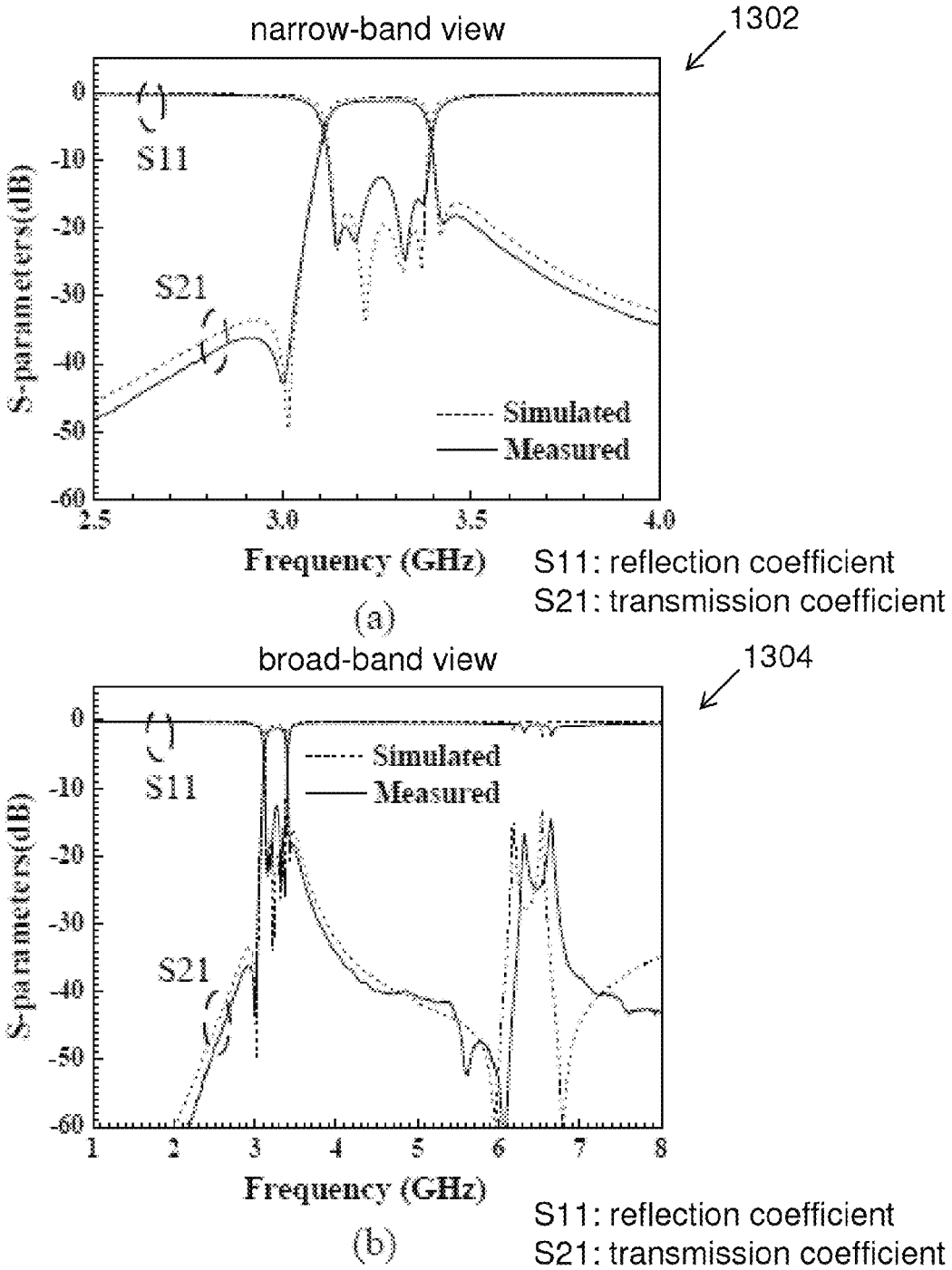
FIG. 13(*a*) shows the graphs of the measured and simulated results for the fabricated quasi-elliptic response via-coupling band pass filter of FIG. 12 in a narrow-band view, and FIG. 13(*b*) shows the graphs of the measured and simulated results for the fabricated quasi-elliptic response via-coupling band pass filter of FIG. 12 in a broad-band view.

For the purpose of verification, a quasi-elliptic response band pass filter is fabricated in accordance with FIG. 9 on the Duroid 5870 substrate and measured by Vector Network Analyzer (VNA). FIG. 12 shows a fabricated quasi-elliptic response via-coupling band pass filter 1200 in accordance with one embodiment of the present invention. The measured and simulated results of the fabricated quasi-elliptic response BPF in FIG. 12 are given in FIGS. 13(*a*) and 13(*b*) in a narrow-band view 1302 and a broad-band view 1304. Again, good agreements are observed between the measured and simulated results. This implies a certain extent of tolerance to fabrication errors in the present embodiment of the band pass filter of the present invention. As shown in FIGS. 13(*a*) and 13(*b*), the measured in-band insertion loss is around 1.2 dB and the return loss is greater than 12 dB. Also, two TZs are realized close to the pass-band edge, which guarantee high selectivity. The second-order harmonic is suppressed to some extend as two $\lambda/4$ UIRs are employed.

Although the present invention has been described in detail with reference to the above embodiments and Figures, there are several important aspects of the present invention that should be highlighted.

First, the via-coupling mechanism of the present invention is substantially independent of the substrate permittivity $\epsilon$. Therefore, FIG. 3 is applicable to substrates of different permittivity.

Also, although the study and design in the embodiments of the present invention are based on the uniform-impedance resonators (UIRs), the via-coupling mechanism is applicable and suitable for any types of resonators. Examples of these resonators include step-impedance resonators (SIRs) and stub-loaded resonators (SLRs). The via-coupling mechanism of the present invention is also suitable for other types of resonators. Furthermore, the via-coupling mechanism of the present invention can be used in resonators that are end-coupled or edge-coupled with each other.

In the present invention, the metallic via in the via-coupling mechanism will slightly affect the resonant frequencies of resonators. However, this influence can be adjusted by tuning the lengths of the resonators. The resonators of the quasi-elliptic response BPF in the present invention may be meandered to reduce the circuit size. Also, the via-coupling mechanism of the present invention is not limited to the design of end-coupled band pass filter. Lastly, the present invention is not limited to the design of microstrip line band pass filter, but can also be used in the design of other types of band pass filters such as but not limited to low temperature co-fired ceramic (LTCC) band pass filters.

The present invention is particularly advantageous in that: a new coupling mechanism, namely via-coupling mechanism, is provided and applied to implement microstrip line filters, in particular, microstrip line end-coupled band pass filters.

Experimental results above show that the via-coupling mechanism provides more flexibility and owns better tolerance to fabrication errors than the gap-coupling mechanism. As fabrication tolerance is a practical issue in filter application and design, the via-coupling mechanism which has enhanced fabrication tolerance may be a good candidate for microstrip line band pass filter designs.

The embodiment of the quasi-elliptic response end-coupled band pass filter of the present invention utilizes via-coupling mechanism in the main couplings and gap-coupling mechanism in the cross couplings. The utilization of the via-coupling mechanism in the main couplings results in a simpler design procedure, more design flexibility and better tolerance to fabrication errors than band pass filters utilizing the traditional gap-couplings mechanism. Also, the utilization of gap-coupling mechanism in the cross coupling guarantees a quasi-elliptic response with high selectivity. More importantly, the present invention can be applied in most planar wireless communication systems.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A microstrip line filter comprising:

a first resonator;

a second resonator, and a coupling mechanism arranged to couple the first resonator and the second resonator, wherein the coupling mechanism includes a shared metallic via with a predetermined dimension associated with a coupling coefficient of the first and second resonators; wherein the shared metallic via has a substantially circular cross section; and wherein the first and second resonators are disposed on a substrate, and the coupling mechanism is a magnetic coupling mechanism substantially independent of a permittivity $\epsilon$ of the substrate.

2. The microstrip line filter in accordance with claim 1, wherein the first resonator has a length, the second resonator has a length, and resonant frequencies of the first and second resonators are dependent on the respective lengths of the first and second resonators.

3. The microstrip line filter in accordance with claim 1, wherein the first and second resonators are end-coupled or edge-coupled with each other through the coupling mechanism.

4. The microstrip line filter in accordance with claim 1, wherein the microstrip line filter is a band pass filter.

5. The microstrip line filter in accordance with claim 1, wherein the coupling mechanism is substantially gapless between the first and second resonators.

6. The microstrip line filter in accordance with claim 1, wherein the first and second resonators are uniform-impedance resonance resonators, step-impedance resonators or stub-loaded resonators.

7. The microstrip line filter in accordance with claim 1, wherein the predetermined dimension of the shared metallic via includes a diameter of the substantially circular cross section of the shared metallic via.

8. The microstrip line filter in accordance with claim 7, wherein the first resonator has a width, the second resonator has a width, and the coupling coefficient of the first and second resonators is further dependent on the respective widths of the first and second resonators.

9. The microstrip line filter in accordance with claim 1, wherein the first and second resonators are $\lambda/2$ or $\lambda/4$ resonators.

10. A microstrip line filter comprising a plurality of resonators, at least one of the plurality of resonators being end-coupled with an adjacent one of the plurality of resonators through a via-coupling mechanism having a shared metallic via; wherein the shared metallic via has a substantially circular cross section; wherein at least one of the plurality of resonators is end-coupled with an adjacent one of the plurality of resonators through a gap-coupling mechanism having a gap disposed between the respective ones of the plurality of resonators.

11. The microstrip line filter in accordance with claim 10, wherein the via-coupling mechanism is a magnetic coupling mechanism; and the gap-coupling mechanism is an electric coupling mechanism.

12. The microstrip line filter in accordance with claim 10, wherein the via-coupling mechanism is substantially gapless between the respective ones of the plurality of resonators.

13. The microstrip line filter in accordance with claim 10, wherein a predetermined dimension of the shared metallic via is associated with a coupling coefficient of the respective ones of the plurality of resonators connected together through the via-coupling mechanism.

14. The microstrip line filter in accordance with claim 13, wherein the predetermined dimension of the shared metallic via is a diameter of the substantially circular cross section of the shared metallic via.

15. The microstrip line filter in accordance with claim 10, wherein a width of the gap of the gap-coupling mechanism is associated with a coupling coefficient of the respective ones of the plurality of resonators connected together through the gap-coupling mechanism.

16. The microstrip line filter in accordance with claim 10, wherein the plurality of resonators are arranged in a split ring structure.

17. The microstrip line filter in accordance with claim 16, wherein the plurality of resonators comprises:

a first resonator connected with a microstrip line input;

a second resonator coupled with the first resonator;

a third resonator coupled with the second resonator; and a fourth resonator coupled with the third resonator and connected with a microstrip line output.

18. The microstrip line filter in accordance with claim 17, wherein each of the first, second, third and fourth resonators is independently selected from the group consisting of $\lambda/2$ resonator and $\lambda/4$ resonator.

19. The microstrip line filter in accordance with claim 18, wherein the first and fourth resonators are $\lambda/4$ resonators; and the second and third resonators are $\lambda/2$ resonators.

20. The microstrip line filter in accordance with claim 17, wherein the gap-coupling mechanism is arranged between the first and fourth resonators; and the via-coupling mechanism is arranged respectively between the first and the second resonators, between the second and the third resonators, and between the third and the fourth resonators.

21. The microstrip line filter in accordance with claim 16, wherein the split ring structure includes a radius; and a center frequency of a pass band of the microstrip line filter is dependent on the radius of the split ring structure.

22. A microstrip line filter comprising a plurality of resonators, at least one of the plurality of resonators being end-coupled with an adjacent one of the plurality of resonators through a via-coupling mechanism having a shared metallic via, wherein the shared metallic via has a substantially circular cross section, and wherein the microstrip line filter is a quasi-elliptic response band pass filter.

* * * * *